United States Patent [19]

Lash

[11] 4,240,349

[45] Dec. 23, 1980

[54] FOLDABLE LINEAR EXPLOSIVE CHARGE

[76] Inventor: Charles C. Lash, 1111 E. 25th St., Tulsa, Okla. 74114

[21] Appl. No.: 941,565

[22] Filed: Sep. 11, 1978

[51] Int. Cl.[3] ..... F42B 3/02

[52] U.S. Cl. ..... 102/24 R; 102/21.6; 403/100; 403/292; 403/341

[58] Field of Search ..... 102/21.6, 24 R, 20; 181/116; 403/341, 100, 102, 292, 293

[56] References Cited

U.S. PATENT DOCUMENTS

| | | | |
|---|---|---|---|
| 1,224,533 | 5/1917 | Guglielmone | 403/100 X |
| 1,906,218 | 4/1933 | Patchell | 403/100 |
| 2,481,814 | 9/1949 | Brecker | 102/24 R |
| 2,558,163 | 6/1951 | Wright et al. | 102/24 R |
| 2,683,414 | 7/1954 | Klotz | 102/21.6 |
| 2,687,093 | 8/1954 | Botts | 102/24 R |
| 2,748,700 | 6/1956 | Breza et al. | 102/21.6 X |
| 3,057,296 | 10/1962 | Silverman | 102/21.6 |
| 3,177,808 | 4/1965 | Owen | 102/20 |
| 3,244,099 | 4/1966 | Lang et al. | 102/20 |
| 3,289,583 | 12/1966 | Silverman | 181/116 X |

*Primary Examiner*—David H. Brown
*Attorney, Agent, or Firm*—Daniel Silverman

[57] ABSTRACT

A foldable linear explosive charge (FLEC) comprising a plurality of similar tubular members which are hinged to each other at their ends so that they can be extended co-linearly to form a long tubular member or can be hinged and relatively rotated 180° from each other to form a zig-zag folded system suitable for transport or storage. While in extended form, with the tubular members co-linear, they are wound with a helix of linear explosive compound (LEC). At the joints between each pair of tubular members, the LEC passes directly over the hinge, so when that joint is rotated from closed (folded) to open (linear) position, the explosive member is not moved, except for a rotation, in which it returns from a slight torsion. The FLEC is carried in a container in the folded condition and when it is to be inserted into a drilled shot hole, each successive pair of sticks is unfolded into a co-linear position and lowered into the shot hole.

11 Claims, 11 Drawing Figures

FOLDABLE LINEAR EXPLOSIVE CHARGE

BACKGROUND OF THE INVENTION

1. Field of the Invention

This invention lies in the field of explosive charges used in seismic geophysical prospecting.

More particularly, this concerns an improvement in the construction of long linear explosive charges in that they are made of a plurality of separate sticks which are attached by hinges between their abutting ends, so that after the string of sticks are placed in co-linear position, they can be wound with a helix of elongated explosive material in such a way that the hinged joints can be rotated and the charge folded into a plurality of parallel sticks without disturbing the explosive material.

2. Description of the Prior Art

It is well known in the art that a linear explosive charge comprising a helix of linear explosive material when designed with a proper diameter and spacing between helical turns, provides an improved seismic record over the conventional type of concentrated point charges. explosive material, is necessary because the available explosives detonate at a velocity much greater than the velocity of propagation of seismic waves in the earth. The pitch of the helix is designed to provide a match with these velocities.

In spite of the noticeably improved seismic records recorded when these linear charges are used, the Geophysical Industry has been reluctant to utilize them for a number of reasons. One reason results from the experience that when such charges are loaded into a hole at the time the hole is drilled, and not shot for some considerable number of days, there are occasionally misfires, in the sense that the charge does not completely detonate. Such failures to completely detonate are expensive and time-consuming difficulties.

Part of the reason for the failure to detonate stems from two problems. One is that the paper tubes on which the explosives are wound sometimes becomes soft and slump in the water filling the hole and, consequently, the spacing between turns may become smaller, to the point where a cross-detonation occurs from one turn to the other which vitiates the usefulness of the charge.

A second and more important problem is that in the prior art the separate sticks of linear explosive charge were made with fastening means, such as screw threads, by which they can be attached end-to-end and inserted into the drill hole. However, when this is done, particularly where the two sticks must be rotated with respect to each other, there is no satisfactory way of joining the two ends of the linear explosive compound, such as Primacord, for example, so that there will be positive detonation across the joint between the Primacord on each of the adjacent sticks.

The most common construction of the explosive sticks involves sealing the two ends of the Primacord and inserting the two ends, one from one stick, and the other from the other stick, through an opening between the sticks along the axis of the charge, so that the two lengths of Primacord are in intimate parallel contact. Under good dry conditions, at this kind of a joint, the detonation of one cord will cause the detonation of the other cord. However, for various reasons, such as leakage of water into the metal caps, or displacement of the two lengths of cord one from the other, or other reasons, misfires do occur at the junction between the two ends and, of course, the charge fails to detonate completely throughout the whole length.

In the prior art there has been some work done on utilizing a flexible tubular member such as a heavy walled rubber hose which is stretched linearly and rotated while Primacord is wound in a continuous length from one end to the other of the hose. This type of construction will definitely show fewer misfires than the type previously described in which separate sticks are coupled together. However, the time of the workmen in the field which is required to wind these separate charges is prohibitive except for special research assigns, and it cannot economically be justified in the routine operation of a seismic geophysical party. Furthermore, the average person working as a laborer on the seismic party is not well enough trained to "manufacture the distributed charge in place".

SUMMARY OF THE INVENTION

It is a primary object of this invention to provide a long foldable linear explosive charge in which the linear explosive compound, such as Primacord, for example, is wound continuously in a helix from one end of the long charge, to the other end, at the factory; the long charge comprising a plurality of separate hinged sticks, is folded into a zig-zag configuration with the individual sticks substantially parallel to each other, placed in a container, and transported.

It is a further object of this invention to provide a foldable linear explosive charge comprising a large plurality of separate sticks, which are successively hinged to each other, which can be wound as a single extended linear unit, folded for transportation into a compact package, and opened into a linear member again for insertion into the shot hole, while using a single continuous length of explosive charge.

These and other objects are realized and the limitations of the prior art are overcome in this invention, by providing a type of hinged joint between successive rigid tubular members, of selected lengths, diameter, and wall thickness, of suitable material that will not soften in contact with the water in the shot hole, and will be sufficiently rigid so that the charge can be pushed and pulled, as it is lowered into the shot hole. A selected type of hinged joint is provided, by means of which each adjacent two sections of explosive, which are called sticks, can be hinged together, with the hinge member positioned longitudinally across the joint, between the abutting ends of two coaxial sticks. By relatively folding one stick about the other, the hinge opens into 180° position, and the two sticks become parallel to each other while joined by the hinge at their contacting ends. After the sticks are joined by appropriate hinges and positioned in extended form, the unit is wound with explosive material such as Primacord in the form of a helix, of selected spacing, along the tubular member. As the Primacord wrap approaches the junction between two abutting ends of adjacent sticks, the Primacord crosses the junction at the location of the hinge so that when the final wrapped charge is folded, and a joint is opened by rotating adjacent sticks through 180°, the Primacord rests on the outer surface of the hinge and is not moved. The hinge is bent around the Primacord at that point.

Various types of joints can be designed, and various types of hinges used. For example, it is desirable to have a tubular insert in one end of one tubular member which extends beyond the joint, so that as the hinged parts are rotated into coaxial position, the projecting end will be inserted into the opposite end of the adjacent stick and form an aligning member.

Also, it is possible, instead of providing a straight right angle cut on the ends of the tubular members, they can be cut in a stepped cut, where one half of the circumference of the tube extends slightly beyond the other half of the tube. When the two ends of the sticks are abutted, the extension of one fits into the shorter portion of the other. Also, the longitudinal edges prevent relative rotation about the axis of the two tubes.

The life expectancy, in the sense of the number of folding and unfolding operations, of the hinge need not be great, in view of the fact that a relatively few number of rotations of the sticks about the hinge will be made in the life of the explosive charge. Consequently, a very simple hinge might comprise a strip of suitable flexible material, such as cloth or plastic, covered with adhesive at its ends so that it can be attached along one side of the pair of ends of the tubes. If desired, a wrap of tape can hold the ends of the hinge in position, so that a considerable tensile strength can be developed.

Another mode of construction would be to utilize a molded plastic flexible material with two thick ends and a central thin portion of suitable flexibility. The thick ends can be attached with suitable adhesive or by rivets or similar means, to the wall of the tubes.

Another type of construction can involve the use of collars by means of which adjacent tubular members can be joined. Each collar would comprise two hinged parts, of substantially the same diameter so that of the tubular material and each having tubular inserts extending in both directions out of the collar. These extensions can be inserted and fastened into the ends of the sticks so that having previously prepared the collars, the assembly of a plurality of sticks into an elongated charge can be quite simple and rapid.

A simple method of construction might involve the use of suitable plastic material for the tubes which are made by extrusion, and the inserts, for example, can be fastened by suitable cement which can develop shear strength almost as great as that of the tensile strength of the material.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENTS

Figure 1:
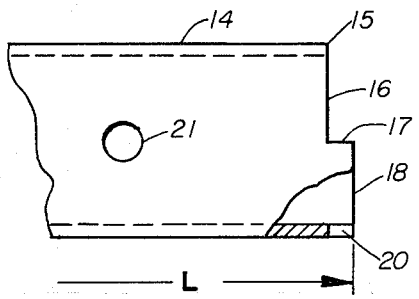
FIGS. 1, 2, 3, and 4 show various views of the three parts which form a joint between two sticks.

Referring now to the drawings and in particular to FIGS. 1–5, there are shown a first end of a first stick comprising tubular member 14 of suitable diameter, wall thickness, and length L. The first end of the first stick comprises two parallel cuts 16 and 18, each of which comprise cuts of half of the perimeter of the stick 14 and including two longitudinal edges 17. These edges 17 are for the purpose of preventing relative axial rotation of adjacent sticks.

Figure 2:
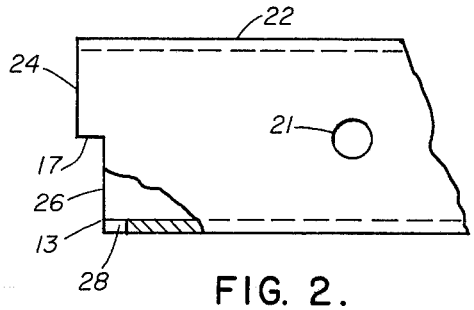
Figure 3:
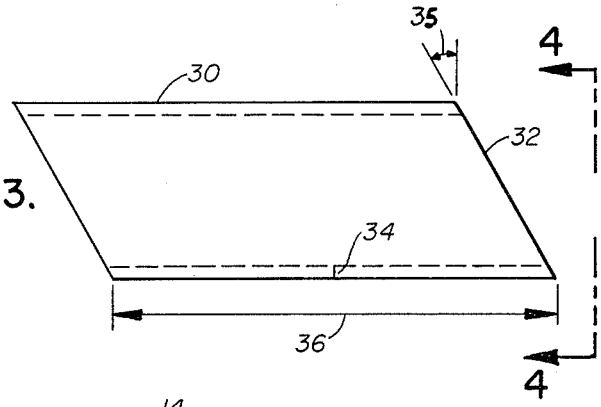
Figure 4:
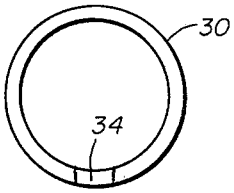

FIG. 2 illustrates the second end of a second stick 22 comprising an equal length of tubular member identical to that to FIG. 1. Again, the end is formed in a step cut, having a shorter portion 26 and a longer portion 24, with corresponding longitudinal edges 17.

Figure 5:
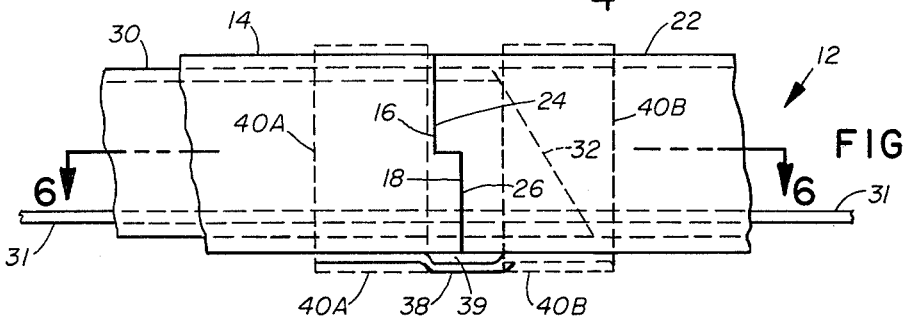
FIG. 5 illustrates a completed joint between two sticks.

When the end 13 of stick 22 is meshed with the end 15 of stick 14, the extension 24 will fit to the shorter portion 16 and the shorter portion 26 will fit with the extension 18 to form a joint which is shown in FIG. 5. This type of construction can be used in order to provide a more rigid lock between the two sticks because of the longitudinal edges 17.

In order to co-axially align the two ends, the first end 15 of the first stick 14 has an internal insert of a tubular element 30 which is of a diameter such as to be lightly pressed into the inner surface of the end 15. It is positioned with an extension 32 of selected length beyond the end 15. While the end 32 of the insert 30 can be perpendicular to the axis, it is preferred to cut it at a selected angle shown in FIG. 3 identified by numeral 35. While this is not critical, an angle of 30° is found to be preferable. A groove or notch 34 is cut into the insert 30 for a selected length shown in FIGS. 3 and 6.

It will be clear from examination of FIG. 5 that by rotating 22 clockwise about hinge 38, there may be some interference between the portion 24 of 22 and the top of 32. Some friction is desirable, but if there is too much, then the cut 32 can be moved to the left, or the slope of the cut can be changed to say 45°, for example. No dimensions can be given since they will depend on the material of the tubes, the stiffness of the tubes, and the type of hinge, etc.

While these sticks 14 and 22 and the insert 30 can be of any selected material, which has sufficient mechanical rigidity, it is possible to make them of an extruded plastic of conventional substance such as used for plumbing pipes, and so on. Such pipes are joined by means of a cement or solvent such that when two surfaces are coated with the cement and pressed together, they are instantly bonded, and provide a joint of good rigidity and strength. Thus, the insert 30 could be coated with cement and inserted into the end of the tube 14 to provide the desired construction.

The two mating ends 15 and 13 of the tubes 14 and 22 respectively have notches 20 and 28 cut in the ends for a selected distance, of substantially the same width as the cut 34 in the insert 30. The purpose of this will be explained in detail in connection with FIG. 11.

Figure 6:
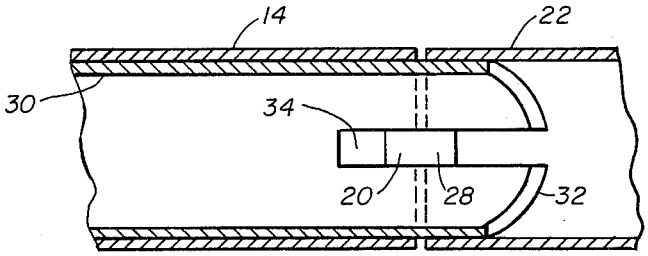
FIG. 6 illustrates a cross-sectional view taken across the plane 6—6 of FIGURE 5.

FIG. 6 illustrates a cross-section taken through the joined portion of tubes 14 and 22 along the plane 6—6 of FIG. 5, with the cut 34 of the insert 30.

Figure 7:
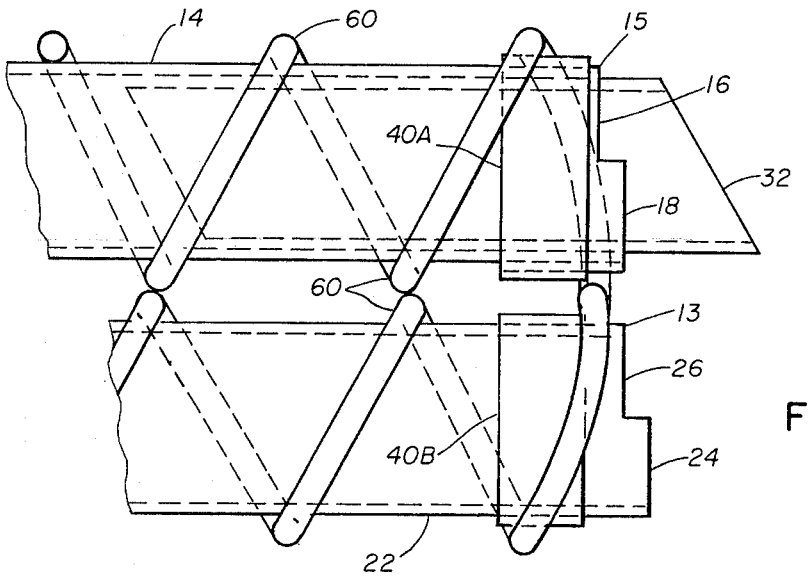
FIG. 7 illustrates a view of a completed charge with the two adjacent sticks hinged into a parallel position.

Referring again to FIG. 5, there is shown a hinge which comprises a strip of adhesive tape 38, the central portion of which is covered with a small piece of material 39 so that the adhesive surface of the strip 38 does not contact the tubes 14 and 22 for a short distance. The ends of the strip 38 are pressed with the adhesive in contact with the sides of the tubes and the corresponding ends of the strip are wrapped 40A and 40B to properly anchor the two ends of the hinge to the corresponding ends of the sticks. The length of the piece 39 is designed to allow the sticks, when in the parallel folded position for transport to avoid undue pressure in the Primacord. As shown in FIG. 7, the surfaces of the two tubes are separated by about twice the diameter of the Primacord.

After the joints are completed, the adjacent sticks are folded into co-linear position, and the Primacord, or other linear explosive charge 60 (FIG. 7) is wrapped in a helix around the tubes 14 and 22 with a proper longitudinal spacing. When the helix crosses the joint 16, 18, that the Primacord 60 also crosses the outer surface of the hinge. In this way, when the two sticks are folded, as shown in FIG. 7, there is relatively no movement of the Primacord at the hinge, although it may be twisted slightly. The joints can be broken as shown. Then, as the stick 22 is rotated couterclockwise, the tip 32 of the insert fits inside of the tube 22 and guides the two tubes together into a co-linear arrangement.

Figure 8:
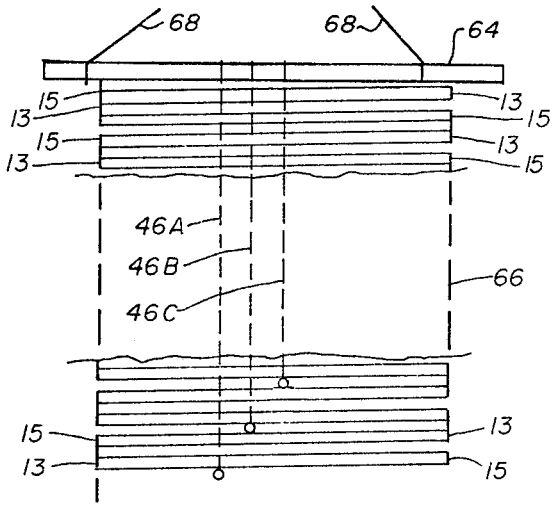
FIG. 8 illustrates one possible manner of installing a folded linear charge into a shot hole.

There are many ways in which the multiple sticks, which may be of the order of 15 or 20 or more, and which may be of a length of the order of 5 feet, or more, to provide a total length of explosive charge of say 100 feet, can be packaged and transported. One suggestion is shown in FIG. 8 in which say 20 sticks having ends 15 and 13 are rotated into parallel positions as shown and laid on top of a cardboard carton, not shown, but large enough to enclose the completed charge. The turns may be tied with strings, such as 46A, 46B, 46C, and so on so that a pole, such as 64, can be inserted through the strings 68, and the pole lifted by means of a crane or A-frame or similar means. By cutting the strings 46A, 46B, 46C, etc., successively, the lowermost pair having the ends 15 and 13 are freed and allowed to hang vertically, and can be dropped into the borehole when the charge is positioned with the edge 66 directly over the shot point. As shown two sticks are lowered into the hole, then the next string 46B is cut, so that another pair of sticks will be free, and will drop down into a linear form and will drop into the bore hole, and so on, until the full 20 sticks (for example, have been lowered into position.

Of course, other means of handling can be provided, for example, the entire group shown in FIG. 8 can be laid flat on the ground and then, by being pulled from one end, can be extended to a linear charge. It then can be carried and raised, so as to form a bend directly over the hole, and lowered into the hole in that fashion, and so on.

Examination of FIG. 8 shows the hinges tying the ends 13, 15 of the successive sticks together. Consider the second stick from the bottom. At end 15, the hinge is fastened to the lower portion of the stick. At the end 13 the hinge is extended upward to the end of the next stick. The hinge at 13 is at the top surface of the stick. It is clear therefore that if the multiple sticks are to form such a zig-zag pattern, the hinges at the opposite ends must be fastened on opposite sides of the stick. Also, as has been clearly stated that the helix must cross the joint between sticks at the hinge. It is therefore clear that there is not an integral number of turns on each stick, but a number N of complete turns, plus an extra half turn, or $N+\frac{1}{2}$ turns per stick.

Figure 9:
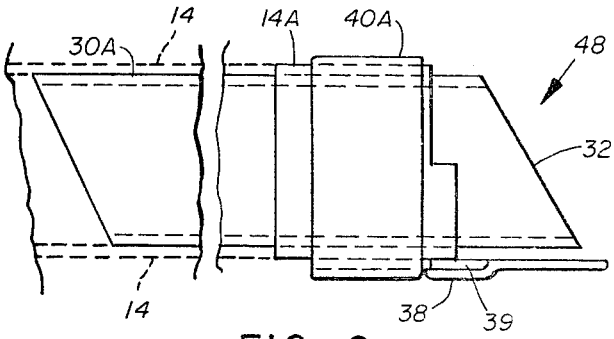

In describing the preferred embodiment illustrated in FIG. 7, the end construction 15, 13 was described as being formed directly on the ends of the two tubular members 14, 22 by cutting and fastening to these members additional fixtures. It will be clear, also, that substantially the same final construction illustrated in FIG. 7 can be made by utilizing identical plain tubular members cut with square ends, and of selected length, and by utilizing a separately assembled hinged coupling collar, for joining a first end of a first member to the second end of a second member, and so on. As shown in FIG. 9, the coupling collar can be made by using a short length 14A of the tubular material of which the sticks 14 and 22 are made. It can also utilize the thin wall tubular element 30A which would be inserted through and fastened into the piece of tubing 14A as shown in FIG. 9. If made of appropriate plastic material, the insert 30A could be cemented into the piece of tubing 14A. Of course, the piece of tubing 14A which now forms the first end of the first stick could be cut with a single perpendicular cut or cut in step fashion as shown in FIGS. 1 and 2, and FIGS. 9 and 10, to provide rotational rigidity between two portions of the coupling collar.

Figure 10:
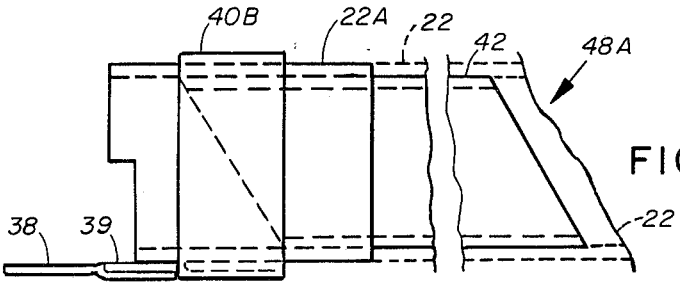
FIGS. 9 and 10 illustrate two component parts of a hinged coupling, which can be used to join two tubular members to form a type of joint similar to that of FIG. 5.

The second part of the coupling collar as shown in FIG. 10 could be a piece of tubing 22A similar to that of 22 with a corresponding insert 42 cemented inside or otherwise attached, and of sufficient length so that it can be inserted into the second tubular member 22, and fastened inside by means of cement, or mechanical fasteners, as desired. The two portions indicated generally by the numerals 48 and 48A, are inserted into each other. That is, part 32 is inserted into part 22A, and then the hinge 38 can be attached as indicated in FIGS. 9 and 10. This might be of any of the several types of hinge which have been discussed previously.

When the parts 48, 48A are attached by hinge means, and after the end 30A of FIG. 9 is inserted into the tubing 14 to form the first end of the stick, and after the end 42 of FIG. 10 is inserted into the tubing 22, shown in dashed outline forming the second end of the second stick, the joint will look very much like FIG. 5. The extended (colinear) first and second sticks, 14 and 22, can then be wound with linear explosive charge 60 as shown in FIG. 7, and in accordance with the description.

While I have described the construction of FIGS. 9 and 10 as using standardized tubing cut into various shapes and assembled, it will be clear that each of the portions 48 and 48A can be separately molded of plastic, in a single operation, even to the attachment of a suitable hinge means between the two parts. Thus, while the general physical shape and arrangement desired is described, the method of manufacture may vary considerably, depending on the specific design of the final coupling.

Figure 11:
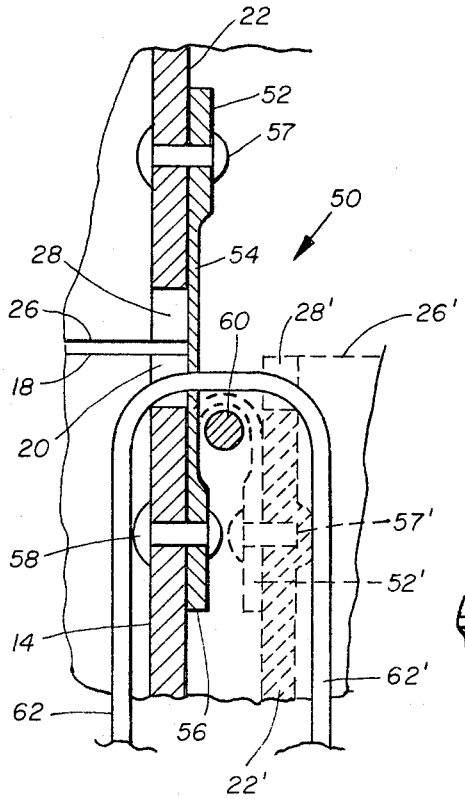
FIG. 11 shows a modified type of hinge construction.

In FIG. 11 is shown another type of hinge construction 50 which involves a type of plastic strip, comprising two end portions 52 and 56, with a central portion 54 of selected length and of somewhat thinner construction, so as to make it more flexible and subject to bending. The thicker ends 52 and 56 can be attached to the sides of the tubular members 22 and 14 in any way desired although one possibility would be cementing in combination with some mechanical support, such as rivets 57 and 58. They can be attached also by wrapping as previously described. In this case the shear strength would depend on the cement, and the wrapping for mechanical strength.

Also shown in FIG. 11, in dashed outline, is the portion of member 22 which is hinged and turned through an angle of 180°, so that the two members 14 and 22 lie alongside each other. Shown in the center of the hinge, is a cross-section 60 of the explosive member. Shown also are the two notches 20 and 28 in the ends of the tubes 14 and 22 respectively. Shown also is a tensile member 62, which can be a plastic cord or rope, or a plastic covered wire rope, which, if needed, can be used to hold the bottom end of the string or support a weight on the bottom end of the string, which can be used to pull the assembly down into the hole.

Alternatively, a loading pole can be attached to the top end of the charge and the whole unit pushed into the hole. The notches 20 and 28 are provided so that the tensile member 62 which has been threaded through the entire charge can bend around the hinge as the separate sticks are rotated to be parallel to each other. Without the slots 20 and 28, there would not be sufficient length to the tensile member to reach around the hinge when the two adjacent sticks were rotated parallel to each other, as shown.

What has been shown is an improved type of distributed charge which, while following the basic construction of the prior art distributed charges, has an additional advantage over those, which are constructed of discreet, separate sticks which must be assembled end-to-end, such as by means of screwed connectors. The necessity for a screwed connector makes it impossible to use a single continuous explosive element and therefore, requires separate connections of the explosive element at each joint between the sticks. These joints in the explosive material are weak spots, so far as detonation is concerned, and are the principal cause for misfires in use of the old style distributed charge. Consequently, since this design and construction of a linear explosive charge permits a single continuous length of linear explosive compound, there is no requirement of cross-detonation between the pairs at each joint of the sticks and, therefore, there is many times greater assurance of a full and complete detonation throughout the whole length of the charge.

In describing the foldable linear explosive charge, I have used various words to describe each of the elements of the structure, such as a member, unit, stick, and so on. Any type of hinge can be used, and any desired type of linear explosive compound, such as Primacord, for example, can be used.

While I have described the construction as a tubular element or member, it will be clear that for purpose of increasing the weight of the charge, so as to provide easier loading into the shot hole, or for any other purpose, weighting material such as sand or other material can be loaded into the inner volume of one or more sticks.

It is contemplated also that one or more openings, such as 21 of FIGS. 1 and 2, may be cut in the wall of each stick 14, 22, for the purpose of water entry into the inside of the tubular members.

It will be clear that the hinges on the two ends of a stick must be on diametrically opposite sides of the cylindrical element. And, since the linear explosive compound must cross the ends of the stick at the hinge, the number of turns must be $N+\frac{1}{2}$, where N can be any positive integer.

While the invention has been described with a certain degree of particularity, it is manifest that many charges may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

I claim:

1. A foldable linear explosive charge (FLEC) comprising at least two units or sticks, each stick having a first end, and a second end, the first end of one stick hingedly attached to the second end of the second stick, both sticks substantially identical, each stick comprising;

(a) a thin-walled tubular member of selected material, wall thickness, diameter, and length;

(b) centering means attached to the first end of a first member, and extending beyond the end of said first member, adapted to be inserted into the second end of a second member;

whereby said centering means serves as an alignment means to ensure coaxial alignment of two members when the second end of a second member is positioned on said centering means, and in end-to-end contact with said first member;

(c) hinge means attached to said first end of said first member, and to the second end of said second member; and (d) a helix of linear explosive compound (LEC) wrapped around and fastened to said first member, starting from said second end, to said first end, then across the joint between said first and second members, and continuing along said second member to the first end of said second member; said LEC positioned so as to cross said joint over the outer surface of said hinge means;

whereby when said second stick is folded about said hinge means with respect to said first stick, said LEC remains between the two parts of said hinge means.

2. The FLEC as in claim 1 in which said hinge means comprises a flexible narrow strip means positioned across the joint between said two sticks, and attached at one end to said first end of said first stick, and at the other end to said second end of said second stick.

3. The FLEC as in claim 1 including means to prevent relative axial rotation of two abutting sticks.

4. The FLEC as in claim 1 in which said plane of said ends comprises a stepped cut in which one half of the circumference extends a selected distance beyond the second half of said circumference;

whereby when said second end of said second stick is coaxially positioned adjacent the first end of said first stick, said projections will be on opposite sides of said members and will lock said sticks against relative axial rotation.

5. The FLEC as in claim 1 including a tensile member positioned inside of said sticks in assembled form.

6. The FLEC as in claim 1 in which said centering means comprises a tubular element inserted into said first end of said first member cut at a selected angle less than 90°, with respect to the axis of said stick;

and wherein the pointed end of said projecting portion is aligned longitudinally with the position of said hinge means.

7. The FLEC as in claim 6 in which said tubular element has a longitudinal cut of selected width from said pointed end a selected distance toward the other end.

8. The FLEC as in claims 5 or 7 including a notch in both ends of each stick aligned longitudinally with said hinge means;

whereby when said first and second sticks are relatively folded 180° are co-linear position, said tensile member will fit into said notches in the mating ends of said sticks.

9. The FLEC as in claim 1 in which the hinge on a first end of a selected stick is positioned diametrically opposite to the hinge on the second end of said selected stick.

10. The FLEC as in claim 9 in which the number of turns of LEC in a stick is $N+\frac{1}{2}$ turns, where N is a selected integer.

11. A foldable linear explosive charge (FLEC) comprising at least two units or sticks, each stick having a first end and a second end, the first end of one stick rotatably attached to the second end of the second stick, both sticks substantially identical, said at least two sticks comprising;

(a) two thin-walled tubular members of selected wall thickness, diameter, and length, the plane of each end perpendicular to the axis of each member;

(b) a hinged coupling collar means for joining a first end of a first member to the second end of a second member; said coupling collar means comprising;

1. a first portion comprising a short tubular piece of selected length and of diameter and wall thickness similar to said member; a first tubular insert adapted to fit snugly inside said first portion, and to extend a selected distance beyond a first end of said first portion, and to extend a second selected distance beyond the second end of said first portion;

2. a second portion comprising a short tubular piece of selected length and of diameter and wall thickness similar to said members; a second tubular insert adapted to fit snugly inside said second portion, and to extend a selected distance beyond the first end of said second portion;

3. said first and second portions fitted together with said first extended part of said first tubular insert inserted into the second end of said second portion;

(c) hinge means fastened along the wall of and across the joint between said first and second portions;

(d) the first end of said first member pressed over and fastened to the second extension of said first insert out of the first end of said first portion; and the second end of said first member pressed over and fastened to the first extension at the first end of said second portion; and (e) a helix of linear explosive compound (LEC) wrapped around and fastened to said first stick from said second end to said first end, then across the joint between said first and second sticks, and continuing along said second stick to the first end of said second stick; said explosive means positioned so as to cross said joint over the outer surface of said hinge means;

whereby when said second stick is rotated about said hinge with respect to said first stick, said explosive means remains between the two parts of said hinge means.

* * * * *